United States Patent [19]

Rapoza

[11] 4,050,316

[45] Sept. 27, 1977

[54] PIPETTE ASPIRATOR DEVICE

[75] Inventor: Edward J. Rapoza, Butler, N.J.

[73] Assignee: Becton, Dickinson and Company, East Rutherford, N.J.

[21] Appl. No.: 628,078

[22] Filed: Nov. 3, 1975

[51] Int. Cl.[2] ..... B01L 3/02

[52] U.S. Cl. ..... 73/425.6

[58] Field of Search ..... 73/425.4 P, 425.6; 128/276, 277, 278

[56] References Cited

U.S. PATENT DOCUMENTS

| | | | |
|---|---|---|---|
| 3,244,009 | 4/1966 | Tietje et al. | 73/425.6 |
| 3,343,539 | 9/1967 | Moorehouse | 73/425.6 |
| 3,595,090 | 7/1971 | Drummond | 73/425.6 |

*Primary Examiner*—S. Clement Swisher
*Attorney, Agent, or Firm*—Kane, Dalsimer, Kane, Sullivan and Kurucz

[57] ABSTRACT

The aspirator body includes a resilient cylinder with a piston reciprocable therein for aspirating a liquid into a pipette. The piston mounted on a pin concentrically held be a hollow plunger. The resilient cylinder and the hollow plunger reciprocates in an annular chamber formed by the body. An extension of the hollow body surrounds the pipette tube when it is held in fluid communication with the body and includes a magnifying lens to facilitate reading of the position of the body and liquid contained therein.

12 Claims, 7 Drawing Figures

Fig. 4
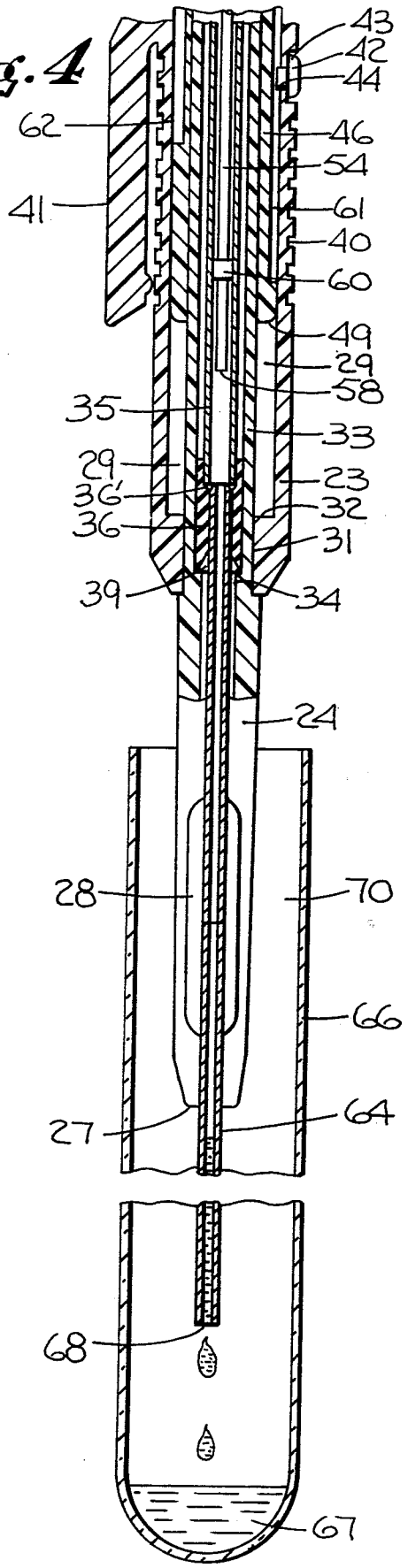
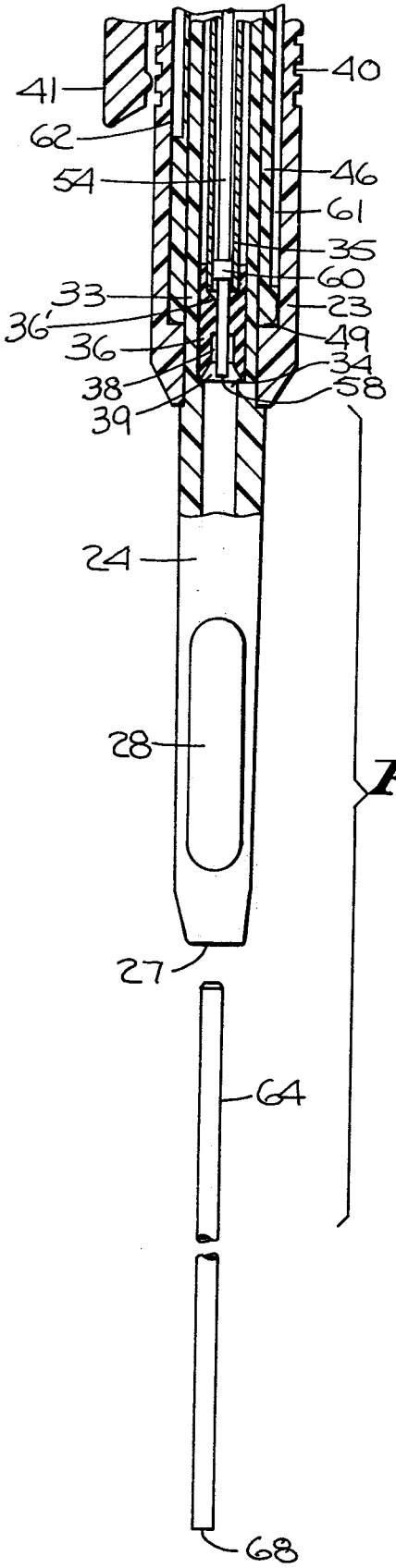
Fig. 5

PIPETTE ASPIRATOR DEVICE

BACKGROUND OF THE INVENTION

In working with fluids such as medicaments and human body fluids, it is often dangerous to have human contact occur with the fluid materials. This is a prevalent problem in pipetting fluids which require a human operator to transfer precise amounts of liquid for testing purposes or other use. The liquid being transported in the pipette could be diseased, radio active or otherwise contaminated, thus endangering the operator.

It is of course imperative that any device which handles the fluids and engages in a pipetting operation be designed so that accurate volumes of fluid can be properly handled. It is often necessary to deal with microliter volumes of quite precise amounts.

Naturally any device that is employed in a pipetting operation should be of low cost construction and of reliability and should be easy and efficient to operate. The problems which should be kept in mind in developing any device of this type include the necessity of pipetting accurate amounts and providing indicating means to assure that accurate amounts have been pipetted while effectively avoiding human contact with the fluids or even with the pipette being utilized. Naturally, the ability to dispose of pipettes without direct human contact after use would also be an advantage since any residual materials could also contaminate the operator.

SUMMARY OF THE INVENTION

With the above background in mind, it is among the primary objectives of the present invention to provide an aspirator for use with micropipettes which eliminates direct human contact with the pipette. The device is designed to accommodate and index a pipette of desired fluid volume and to aspirate and dispense microliter volumes in the calibrated micropipette tubes quickly, efficiently and accurately. In fact, the aspirator is designed with a magnifier portion to index with a fill line on a micropipette to enlarge the image of the fill line and enable the operator to more easily discern the fill point. The aspirator is designed for simple operation with either hand and is configured to be used with common laboratory test tubes. In contrast with higher known devices, the unique design of the device permits the operator to accurately adjust the meniscus of fluid in the micropipette with ease which has not been heretofore possible with classical techniques.

The aspirator is designed for use with at least two different volume micropipettes with a simple adjustment means on the pipette to realign the pipette to draw a different volume of fluid depending upon the pipette being utilized. The pipette can be quickly inserted into the aspirator where it will be automatically held in position with the fill line aligned with a magnifying portion of the aspirator and the aspirator utilized and the pipette then ejected automatically from the aspirator after use without the operator having to handle the pipette at any time subsequent to initial introduction into the aspirator prior to use.

A unique piston assembly is employed which is designed to require low tolerance requirements thereby reducing the overall cost of the manufacture and assembly of the product. The piston assembly includes a flexible somewhat resilient guide through which passes a central pin containing a plastic disc intermediate its ends. The disc engages and slightly expands the inner side walls of the plastic guide tube to form a seal and slidable therewith for reciprocation of the assembly. The flexible nature of the guide member facilitates insertion of the pin and piston therein and its resiliency permits slight expansion as the piston slides therein thereby effecting a seal without close tolerance requirements.

In summary, the aspirator device includes a hollow elongated body member terminating in a forward tip portion at one end and the body is open at both ends. The plunger assembly is positioned in the hollow body member and is reciprocally movable therein. The plunger assembly includes a handle portion. The stop means limits the amount of axial movement of the plunger assembly. Pipette receiving means are in the body adjacent to the tip so that when a pipette is placed in the tip through the open end thereof it can be extended until it is gripped by the pipette receiving means and held in position for use. The plunger assembly is movable away from the tip until stopped so that withdrawal thereof will aspirate a predetermined amount of fluid into the pipette from a fluid source and is movable thereafter toward the reduced tip until it is stopped thereby projecting the fluid from the pipette.

With the above objectives among other, in mind, reference is had to the attached drawings.

BRIEF DESCRIPTION OF THE DRAWINGS

In the drawings:

FIG. 4 is a similar view of FIGS. 2 and 3 showing the fluid in the pipette being dispensed into a receiving vessel;

FIG. 5 is a similar view as FIGS. 2, 3 and 4 and showing the pipette being automatically dispensed from the aspirator device;

DESCRIPTION OF THE PREFERRED EMBODIMENT

Figure 1:
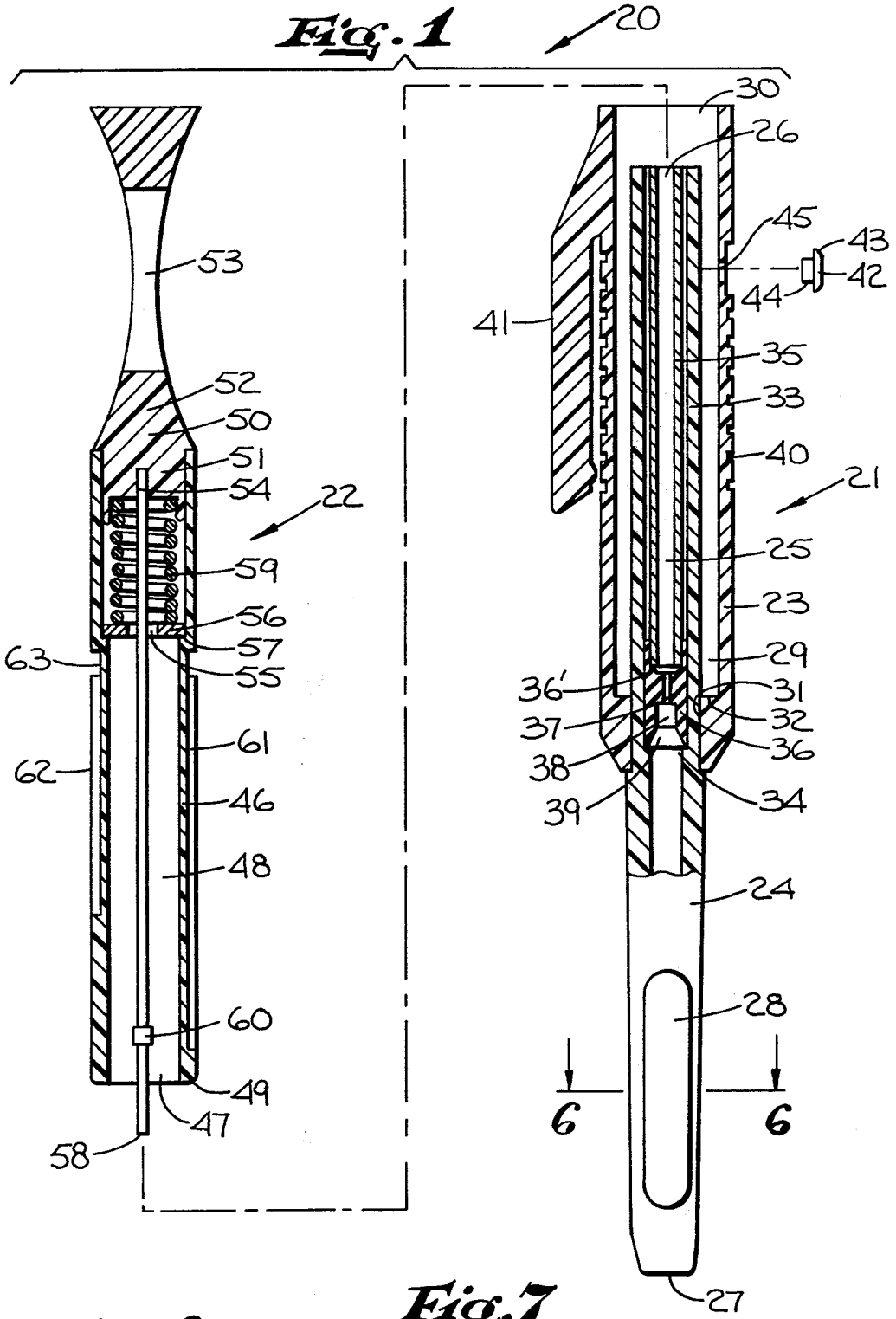
FIG. 1 is an exploded sectional view of the device of the invention.
Figure 6:
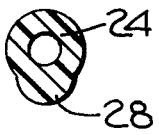
FIG. 6 is a sectional top view thereof taken along the plane of line 6—6 of FIG. 1.
Figure 7:
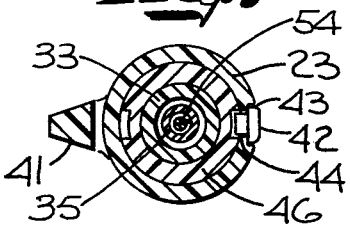
FIG. 7 is a sectional top view thereof taken along the plane of line 7—7 of FIG. 2.

FIGS. 1, 6 and 7 depict the various mechanical elements which comprise the aspirator device 20 and FIGS. 2–5 depict the sequential steps of operation of the device.

Turning initially to the structural components, reference is made initially to FIG. 1. Aspirator 20 includes a body portion 21 and a plunger and pin assembly 22. The body includes a main rear portion 23 and a forward reduced tip 24. A continuous passageway 25 extends from rear open end 26 to forward open tip 27 of the body. Intermediate the ends of the reduced forward tip 24 is a magnifying lens portion 28 through which the fill line of a pipette can be observed as will be discussed in detail below. The reduced tip portion is transparent and it has been found that a transparent material such as methylpentene TPX grade RT-18 is effective for use for the reduced tip. It is not necessary that the entire tip be completely transparent, however portion 28 which is molded or otherwise formed into a plastic projection forming a lens surface to magnify the portion of the through bore 25 of body 21 in alignment therewith.

Actually the entire body portion 21 and plunger and pin assembly 22 can be of a plastic material or an inexpensive metal material with cost being an important factor. As stated above, the only portion that need be transparent is portion 28 through which the fill line of a pipette must be read.

The enlarged rear portion 23 is formed with an interior chamber 29 having an enlarged opening 30 at the top and a narrower opening 31 at the bottom. The narrower opening 31 forms an annular shoulder 32 in cooperation with the inner side walls of the cylindrical tube forming rear portion 23.

Concentrically mounted in chamber 29 of rear portion 23 is an inner hollow guide 33 which extends from the reduced tip 24 toward the rear end of rear body portion 23 and terminating adjacent the rear opening 30 thereof. As shown, the guide 33 can be formed integrally with reduced tip 24 and mounted in opening 31 of rear body portion 23 and affixed in position therein by a convenient means such as by an epoxy bonding. Guide 33 has an opening 34 at the bottom end and terminates in opening 26 at the rear end. Concentrically mounted within the axial chamber through guide 33 is a pin guide 35 which is also open at both ends and terminates in engagement with a flexible resilent insert 36 mounted within guide 33 at the lower end thereof. The insert 36 has a passageway therethrough to provide continuous communication from the rear opening 26 of inner guide 35 to the opening 27 at the end of reduced tip 24.

The pin guide 35 is of a flexible resilient material such as silicone rubber or a resilient flexible plastic or any conventional substitute therefor. The pin guide 35 is flexible and resilient for the purpose of accommodating the piston and pin therein to permit reciprocal movement of the piston and pin while forming a seal therewith. The general object is to maintain an inexpensive combination between the pin guide 35 and the pin and piston assembly so that tolerance requirements for the assembly is kept at a minimum without detracting from the operability or function of the assembly. By making the tubular pin guide 35 resilient so that it can be deformed during sliding engagement with the pin, it is possible to obtain the desired seal without having closed tolerances and without using a deformable or specially designed piston.

Insert 36 can be mounted in convenient fashion such as by epoxy and has a rear receiving cup to affixedly mount the end portion of inner pin guide 36 which has its forward edge in engagement with a beveled shoulder 36. The insert then continues for a very narrow passageway portion 37 opening into a large rectangular shaped passageway 38 and finally opening into a tapered funnel-shaped entrance passageway 39 which communicates directly with the opening through the reduced tip 24. The shape of the passageway through insert 36 is designed for gripping accommodation of a micropipette during use of the aspirator and to facilitate ejection of the pipette automatically after use as will be discussed in detail below The outer surface of rear body portion 23 has a knurled gripping surface portion 40 to facilitate handling of the device and also has an integrally formed clip 41 to facilitate convenient storage of the device when not in use such as by mounting it on a person's pocket. The final element portion of body 21 is a button 42 which has an enlarged head 43 and a reduced diameter projecting tip 44 which is designed for insertion through an appropriate opening 45 in the outer side wall of body rear portion 23. When extended therethrough and affixed in position such as by any convenient means as friction or epoxy, the undersurface of head 43 prevents the full passage of the button into the hollow interior 29 of the body while permitting reduced tip 44 to extend laterally into chamber 29 for engagement with appropriate grooves on plunger and pin assembly 22.

Turning to plunger and pin assembly 22 it includes a plunger rod 46 with an opening 47 at the lower end forming a chamber 48 to receive guide 33 therein. The bottom annular rim 48 is designed for engagement with shoulder 32 within the body portion when full extension of the plunger is accomplished within the body. The chamber 48 terminates at the rear end of the plunger with the undersurface of handle 50. Handle 50 is confirmed to facilitate gripping and use of the aspirator with one hand. It includes a lower block shaped portion mounted within the rear end of plunger 46 and is affixed thereto by friction or epoxy or other convenient means. It serves to close the rear end of the plunger rod. Extending rearwardly from the plunger rod is a ring shaped finger gripping mechanism 52 with a central aperture 53 for passage of a finger which facilitates gripping and reciprocating of the plunger rod with respect to the body 21 when the two are assembled. Affixed in the forward end of block portion 51 of the handle is an elongated pin 54 which passes through an aperture 55 in a washer 56 which is mounted on a shoulder 56 within the plunger rod. The pin extends downwardly beyond the lower annular rim 59 of the plunger rod to form an ejecting tip 58. The washer 56 is slidably mounted within plunger rod 46 so that engagement from the forward end of the plunger rod will force the washer rearwardly to bias a helical spring 59 captured between the undersurface of plug 51 and the upper surface of washer 56. In the normal relaxed position the washer and spring are shown as shown in positioned in FIG. 1.

Spaced a predetermined distance from ejection tip 58 on pin 54 is a stop ring or piston 60. It has been found that a self-lubricating substantially rigid material such as polytetrafluoroethylene plastic can be used effectively as piston or stop ring 60. A stop ring has a larger outer diameter than the remainder of pin 54 which can be of a low cost metal material. The piston engages with the resilient side walls of pin guide 35 and slightly expands the side walls at the point of engagement so as to facilitate formation of a seal at that point. Meanwhile the flexible nature of pin guide 35 permits the axial reciprocal movement of the piston 60 and pin 54 within the pin guide to draw and dispense fluid as desired. By having a flexible and resilient pin guide 35 in cooperation with the inexpensively formed piston and pin assembly, the tolerance requirement for these parts are not particularly stringent. It is merely necessary that there be an interference fit between piston 60 and the walls of pin guide 35 to form the necessary seal. Additionally, assembly is facilitated since the angle at which the pin is inserted into the pin guide is not too significant since it is not necessary to have a closely machined relationship between the parts. The result is a low cost and efficient ejection pin and plunger assembly. On the outer surface of plunger rod 46 are a pair of diametrically opposed grooves 61 and 62 with groove 61 being longer than groove 62. These grooves determine the travel length of the plunger rod and accordingly the volume of fluid which can be aspirated into a pipette associated with device 20 during operation. In communication and cooperating with groove 61 and 62 is an annular groove 63 which permits movement of pin 44 from either groove 61 or groove 62 to the other groove during use.

Figure 2:
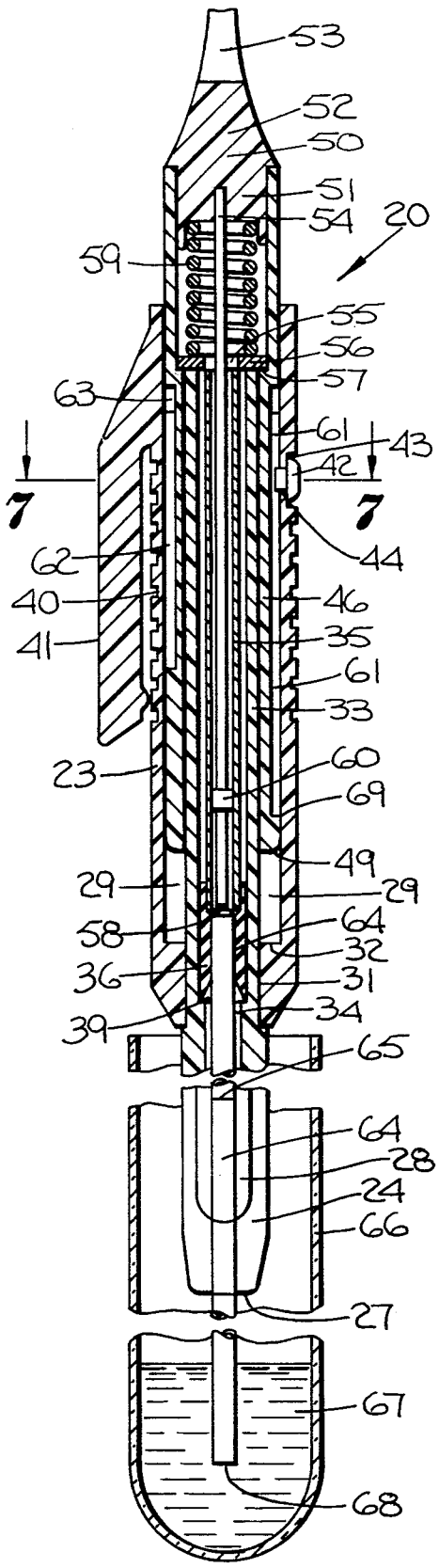
FIG. 2 is a fragmentary sectional elevation view of the aspirator with a pipette in position and inserted into a source of fluid.

The device 20 when assembled is depicted in FIGS. 2–5 and it is accomplished by inserting pin and plunger rod through the open rear end 30 of body portion 21. The guideways in the body portion determine the axial travel path of the pin and plunger. The pin extends through opening 26 in the inner guideway and in the relaxed position has its forward tip 58 adjacent to the entrance to narrow opening portion 36' of insert 36. The plunger rod 46 is positioned between the outer surface of guideway 33 and the inner surface of rear body portion 23 with its relative rotational position determined by engagement between pin 44 and either of the two receiving grooves 61 and 62. In the relaxed position as shown in FIG. 2 the annular communicating groove 63 is to the rear of pin 44 thereby capturing the plunger and restricting its rotational movement with respect to the body of the device. Handle 52 extends beyond the rear opening 30 of body 21 and the assembly is thus complete. Naturally when the device 20 is assembled it is done so before the insertion of pin 42 and thereafter an axial slot is aligned with opening 45 so that pin 44 can be inserted into a receiving groove thereby locking the assembly together.

In operation, device 20 is grasped with one hand and a pipette 64 of desired volumetric capacity is inserted through opening 27 in reduced tip 24 until it is brought into frictional engagement with insert 36 and is stopped by contact with tip 58 of pin 54 at which time it will be indexed and held in position within device 20 for use. The outer diameter of tip 58 of pin 54 is greater than the diameter of the bore through the pipette 64 and preferably less than the outer diameter of the pipette 64. Therefore, the pin will engage with the rear rim of the pipette to form a stop and to function as an ejection means at the end of the aspirating operation. In turn, the pin is small enough in outer diameter so that it can be easily reciprocated within inset 36 in shifting between the ejecting and relaxed position without having a deleterious effect on the surface walls of the insert which could occur if the engagement between the parts would be too tight and repeated use could cause distruction of portions of the resilient insert walls. For the same purpose, the rear end of the pipette 64 is beveled to facilitate its insertion and removal within the insert and thereby alleviating the danger of deleterious effect to the exposed walls of the insert and possible fraying and damage to the material. Should fraying or damage to the insert occur, it would naturally have effect on the ability of the aspirator to hold the pipette in indexed position for use within the aspirator after insertion and before ejection.

Figure 3:
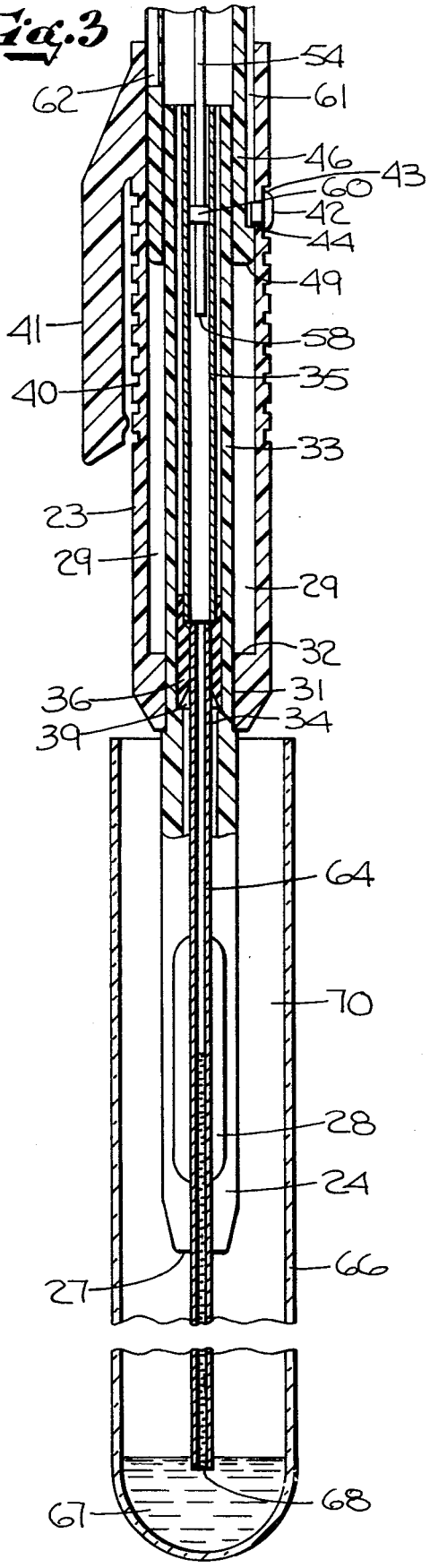
FIG. 3 is a similar view to FIG. 2 after the fluid has been aspirated into the pipette to the desired level.

With the pipette in the seated position, the appropriate fill line 65 for the pipette will be in alignment with the magnifier lens portion 28 of the reduced tip 24 to facilitate observance of the fill line to facilitate accurate filling. Thereafter the micropipette is inserted into a vessel 66 containing the fluid 67 to be handled with the bottom open end 68 of the pipettte immersed in the fluid 67. If desired, vessel 66 can be held with one hand and the aspirator 20 operated with the other hand by inserting a finger through aperture 53 and withdrawing plunger and pin assembly 22. This aspirates fluid into the micropipette to approximately the desired fill line. Further withdrawal of the plunger will cause interference between the bottom 69 of groove 61 and pin projection 44. In this manner, quick withdrawal of the plunger will bring approximately the desired amount of fluid and perhaps a slightly greater volume beyond the fill line into pipette 64. The assembly at this point is depicted in FIG. 3 of the drawings. Thereafter by use of the magnifying portion 28 accurate alignment between the fluid and the fill line 65 can be accomplished by merely dispensing a slight amount of fluid.

The next step would be to dispense the fluid into a further container 70 for testing procedures. This is accomplished by depressing the plunger handle 52 downward, with one hand if desired, until the fluid has been completely dispensed which will normally be accomplished. The pipette 64 can then be simply disposed of by exerting a further force upon handle 53 which causes the upper edge of guides 33 to 35 to force washer 56 upward thereby biasing spring 59 and permitting plunger rod 46 to move downward a greater distance. In the relaxed position the bottom edge 49 of plunger 46 is spaced from shoulder 32 on the rear body portion 23 as shown in FIG. 2. Consequently, continued downward motion of plunger rod 46 and pin 54 is possible by biasing spring 59 upward. This causes ejecting tip 58 of pin 54 to extend downward through openings 37 and 38 of insert 36 and being in engagement with rear rim 74 of the pipette, to force pipette 64 from frictional engagement with resilient insert 36 and to permit the pipette to drop from the device 20 for disposal purposes. Thereafter, release of the handle will return the pin and plunger to the relaxed position removing the bias upon spring 59 and the device will once again be in the relationship depicted in FIG. 2. During the entire sequence of operations, once the pipette 64 has been positioned and held within the device it is not necessary for the operator to touch the pipette again while fluid is being drawn into the pipette or dispensed therefrom or even while the pipette itself is being dispensed after use. Thus the direct contact and possible contamination of the operator is minimized and effectively eliminated.

Device 20 is designed for use with different sized pipettes for different volumes. In the embodiment depicted there are two separate volumetric controls and naturally it is contemplated that a number of grooves like 61 and 62 can be applied about the periphery of plunger 46 to enable the device to be used with different volumetric capacities.

To shift from one volumetric capacity to another, it is merely necessary to depress handle 52 thereby biasing spring 59 and causing the body 21 to move relative to the plunger and pin assembly 22 until projecting pin 44 extends to the upper extremity of slot 61 or 62 or engages with annular groove 63. Then handle 52 can be rotated so that pin 44 passes around into the position of slot 62 at which time it will drop into the slot under the force of spring 59 tending to return to the relaxed position. In the relaxed position pin 44 would then be captured within slot 62 preventing relative rotation between body 21 and pin and plunger assembly 22. The shorter travel length of slot 62 would then permit use with a different volumetric pipette having a lesser volume capacity.

An appropriate window, not shown, can be provided through the wall of rear body portion 23. The window can be positioned so that it will be aligned with appropriate indicia on the surface of plunger 46 so that it is indicated to the user whether groove 61 or 62 is engaging pin 44 at the time. The indicia would indicate the volume which can be drawn upon reciprocation of the plunger into an appropriate micropipette.

Suggested steps to be followed by a technician in utilizing device 20 include the following. The aspirator is adjusted by depressing the plunger fully to the stop position and twisting until the desired volume appears in the window of body portion 23. An appropriate pipette is then inserted into the open end reduced tip 24 until it seats within insert 36 which may be constructed of rubber or other resilient material to frictional engage the pipette. This is done without moving the plunger. The graduation mark 65 should then be aligned with the magnified area 28 of reduced tip 24. The pipette 64 is then inserted into the solution to be pipetted. The plunger is slowly withdrawn with either the forefinger or thumb until the fluid is slightly above the indicator line 65. The specimen meniscus is then adjusted to the top of the calibration line 65 by carefully depressing the plunger. This may be more easily accomplished by holding the body portion 21 with one hand and the stem of handle 52 with the other hand between the thumb and forefinger. Then the plunger is carefully depressed while observing the meniscus level and graduation mark through the magnified area. When they are in alignment, the excess liquid is wiped from the outer surface of the pipette with the operator being careful not to touch the opening 27 which might disturb the volume to be dispensed.

The pipette contents are then expelled into an appropriate vessel by depressing the plunger to the first stop positioned which is the normal relaxed position without placing a bias upon spring 59. The pipette is rinsed two or three times depending upon the viscosity of the fluid drawn into the pipette by repeating the withdrawal/-depression of the plunger. The final rinse is then drained. After completing the pipetting, the entire pipette may be expelled from the aspirator by fully depressing the plunger biasing the spring and causing the pin to eject the pipette.

It is possible with a slight alteration in structure to obtain a blow-out effect to assist in cleaning the structure after use. The change would involve forming an indexing or stop means for the rear rim 64 of the pipette which is only partially through the full length of the insert 36 and not in direct contact with the plunger assembly and pin 54. With that type of arrangement, there would be a small air space between the top of the pipette and the bottom of the pin portion of the plunger assembly. Therefore, when fluid is aspirated by withdrawing the plunger, the air space would still be present and when the plunger is pushed downward to dispense fluid the air space would provide a margin between the top of the fluid column and the bottom of the pin and would serve to act as a blow-out force for insuring that all fluid is dispensed from the assembly. Thereafter, further depression of the plunger would cause the pin 54 to come in contact with the pipette 64 and eject the pipette from the aspirator device. Naturally the volume fill line would be adjusted on the pipette so that it is in the proper position with respct to the magnifier portion of the aspirator when the end of the pipette has been indexed at the desired point within insert 36 and not bottomed against pin 54.

The aspirator is designed so that it will accept a standard pipette and permit the volume fill line of that pipette to be aligned with the magnifying portion of the aspirator device independent of the volume of fluid being aspirated. For example, a distance of 1.4 inches can be provided from the rear tip of the pipette to the fill line so that insertion of the pipette into the aspirator will bottom the rear end of the pipette against the plunger or other stop means and automatically bring the fill line 65 into alignment with the magnifying window. The indexing distance would be independent of the volumes of fluid being aspirated in micro quantities.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An aspirator device comprising:

a hollow elongated body member terminating in a tip portion at one end and being open at both ends;

a hollow plunger and pin guide open at both ends and extending rearwardly from the tip portion concentrically within the body portion;

a plunger rod and pin assembly reciprocally mounted in the body and having a handle portion thereon;

the guide cooperating with the body to control the direction of travel of the plunger rod and pin assembly;

stop means limiting the amount of axial movement of the plunger rod and pin assembly;

pipette receiving means in the body adjacent the tip so that when a pipette is placed in the tip through the open end thereof it can be extended until it is gripped by the pipette receiving means and held in position for use;

the plunger being movable away from the tip until stopped so that withdrawal thereof will aspirate a predetermined amount of fluid into the pipette from a fluid source and being movable thereafter toward the reduced tip until stopped thereby projecting the fluid from the pipette; and the pin having a piston mounted intermediate its ends for slidably sealing engagement with the walls of the guide with the guide having sufficient resilience and flexibility to permit reciprocal movement of the pin and piston therein with the piston slightly deforming the walls of the guide as it passes therethrough to facilitate the sealing interengagement therewith thereby reducing the need for strict coaxial alignment of the piston and the hollow guide.

2. The invention in accordance with claim 1 wherein the guide is a metal rod and the piston is a tetrapolyfluoroethylene piston, the guide is of flexible and slightly resilient plastic and the remainder of the device is of a substantially rigid plastic material.

3. An aspirator device comprising:

a hollow elongated body member terminating in a tip portion at one end and being open at both ends;

a hollow plunger and pin guide open at both ends and extending rearwardly from the tip portion concentrically within the body portion;

a plunger rod and pin assembly reciprocally mounted in the body and having a handle portion thereon;

the guide cooperating with the body to control the direction of travel of the plunger rod and pin assembly;

stop means limiting the amount of axial movement of the plunger rod and pin assembly;

pipette receiving means in the body adjacent the tip so that when a pipette is placed in the tip through the open end thereof it can be extended until it is gripped by the pipette receiving means and held in position for use;

the plunger being movable away from the tip until stopped so that withdrawal thereof will aspirate a predetermined amount of fluid into the pipette from a fluid source and being movable thereafter toward the reduced tip until stopped thereby projecting the fluid from the pipette; and biasing means being provided for cooperating with the stop means and the plunger rod and pin assembly to permit at least the pin to move an additional distance toward the reduced tip when subjected to a predetermined additional force applied to the handle whereupon application of the additional force moves the pin further toward the reduced tip and displaces the pipette from the receiving means for rejection and disposal thereof after use, the outer diameter of the pin being slightly larger than the diameter of the central hole in the pipette to permit engagement between the pin and pipette and the pin having a lesser outer diameter than the outer diameter of the pipette to facilitate passage of the pin through the portion of the device holding the pipette during use.

4. The invention is accordance with claim 3 wherein the pipette receiving means is a resilient rubber hollow insert tapering from a wider open end adjacent the tip to a narrower rear end so that insertion of the pipette through the tip will bring it into the insert and into frictional engagement therewith to be held in position during use, the rear end of the insert being open to receive the pin therethrough upon exertion of additional force to the plunger handle so that the pin can engage a pipette held within the insert and ejected therefrom to permit its free fall displace from the aspirator device.

5. The invention in accordance with claim 4 wherein the plunger rod is housed between the interior surface of the body portion and the exterior surface of the guide portion and the pin is slidably mounted within the hollow bore of the guide portion, the guide portion terminating in a shoulder for engagement with a helical spring captured between the shoulder and the undersurface of the handle portion of the plunger rod, stop means adjacent the end of the pin for engagement with a shoulder on the guide means to restrict the additional movement of the pin in one direction, a shoulder on the bottom end of the body portion for engagement with the end of the plunger rod to restict movement of the plunger rod in the forward direction, a rear restricting pin extending inwardly inwardly through the body portion adjacent the rear end thereof for engagement with a rearward stop shoulder on the plunger rod to restrict the rearward reciprocal travel of the plunger rod with respect to the body portion so that shoulder engagements are provided adjacent both ends of the body portion to limit the travel of the plunger with respect to the body portion.

6. The invention in accordance with claim 5 wherein the handle portion includes a ring-shaped gripping surface to facilitate operation of the aspirator with one hand, the ring-shaped portion of the handle being entirely outside of the body portion during operation of the aspirator.

7. An aspirator device comprising:

a hollow elongated body member terminating in a tip portion at one end and being open at both ends;

a hollow plunger and pin guide open at both ends and extending rearwardly from the tip portion concentrically within the body portion;

a plunger rod and pin assembly reciprocally mounted in the body and having a handle portion thereon;

the guide cooperating with the body to control the direction of travel of the plunger rod and pin assembly;

stop means limiting the amount of axial movement of the plunger rod and pin assembly;

pipette receiving means in the body adjacent the tip so that when a pipette is placed in the tip through the open end thereof it can be extended until it is gripped by the pipette receiving means and held in position for use;

the plunger being movable away from the tip until stopped so that withdrawal thereof will aspirate a predetermined amount of fluid into the pipette from a fluid source and being movable thereafter toward the reduced tip until stopped thereby projecting the fluid from the pipette; and the tip portion being transparent and including a magnifying lens portion intermediate its ends for alignment with a volume fill line on a pipette to facilitate perception of the fill line by the user and facilitate accurate aspiration of the desired amount of fluid into the pipette during use.

8. An aspirator device comprising:

a hollow elongated body member terminating in a tip portion at one end and being open at both ends;

a hollow plunger and pin guide open at both ends and extending rearwardly from the tip portion concentrically within the body portion;

a plunger rod and pin assembly reciprocally mounted in the body and having a handle portion thereon;

the guide cooperating with the body to control the direction of travel of the plunger rod and pin assembly;

stop means limiting the amount of axial movement of the plunger rod and pin assembly;

pipette receiving means in the body adjacent the tip so that when a pipette is placed in the tip through the open end thereof it can be extended until it is gripped by the pipette receiving means and held in position for use;

the plunger being movable away from the tip until stopped so that withdrawal thereof will aspirate a predetermined amount of fluid into the pipette from a fluid source and being movable thereafter toward the reduced tip until stopped thereby projecting the fluid from the pipette; and the plunger rod and pin assembly being rotatably mounted within the body portion and the outer surfaces of the plunger rod having at least one slot with each slot adapted to be aligned with a rear stop projection extending inwardly through the body portion to limit the withdrawal distance of the plunger rod with respect to the body and thereby control the amount of fluid to be introduced in a pipette mounted in the aspirator, an annular groove adjacent the rear end of the plunger rod portion within the body and communicating with a pair of opposed slots and being spaced rearwardly from the stop and extending through the body portion, the positioning being such that application of additional force to the plunger rod will bring the annular groove into alignment with the inwardly projecting pin through the body portion and permit location of the plunger rod until the desired longitudinal slot is in alignment with the pin through the body portion whereupon release of the plunger rod will permit its return to the relaxed position locking the rotational movement of the plunger rod in position and prohibiting reciprocal travel thereof beyond the length of the slot in which the pin projecting through the body portion of the aspirator device is located.

9. The invention in accordance with claim 8 wherein an opening is in the side wall of the body portion corresponding to each slot in the plunger rod to form a window for observing indicia on the plunger rod indicating the volume which can be aspirated into a pipette due to the length of the groove in the plunger rod.

10. An aspirator device comprising:

a hollow elongated body member terminating in a tip portion at one end and being open at both ends;

a plunger assembly positioned in the hollow body member and reciprocally movable therein and having a handle thereon;

stop means limiting the amount of axial movement of the plunger assembly;

ejection means on the plunger and body member;

pipette receiving means in the body adjacent to the tip so that when a pipette is positioned in the tip through the open end thereof it can be extended until it is held in position by the pipette receiving means; and the plunger assembly being movable away from the tip until stopped so that withdrawal thereof will aspirate a predetermined amount of fluid into the pipette from a fluid source and being movable thereafter toward the tip until stopped thereby projecting the fluid from the pipette and upon application of additional force the ejection means will be activated to eject the pipette from the aspirator device.

11. An aspirator device comprising:

a hollow elongated body member terminating in a tip portion at one end and being open at both ends;

a plunger assembly positioned in the hollow body member and reciprocally movable therein and having a handle thereon;

stop means limiting the amount of axial movement of the plunger assembly;

pipette receiving means in the body adjaccent to the tip so that when a pipette is placed in the tip through the open end thereof it can be extended until it is held in position by the pipette receiving means;

indexing means on the pipette and on the aspirator device to permit location of the pipette in the body member for facilitating aspiration of the desired amount of fluid into the pipette and facilitating identification of the presence of the precise amount of fluid drawn into the pipette by the aspirator device; and the plunger assembly being movable away from the reduced tip until stopped by the stop means so that withdrawal thereof will aspirate an amount of fluid into the pipette from a fluid source and being movable thereafter toward the tip until stopped thereby projecting the fluid from the pipette.

12. An aspirator device comprising:

a hollow elongated body member terminating in a tip portion at one end and being open open at both ends;

a plunger assembly positioned in the hollow body member and reciprocally movable therein and having a handle thereon;

stop means limiting the amount of axial movement of the plunger assembly;

pipette receiving means in the body adjacent to the tip so that when a pipette is placed in the tip through the open end thereof it can be extended until it is held in position by the pipette receiving means;

indexing means on the device and on the pipette for facilitating location of the pipette in the desired position for aspiration of the predetermined amount of fluid therein and identification of the presence of the desired amount of fluid therein;

a portion of the body being transparent and including a magnifying lens portion intermediate its ends for alignment with a volume fill line on a pipette to facilitate perception of the volume fill line by the user and to facilitate accurate aspiration of the desired amount of fluid into the pipette during use;

the plunger assembly being movable away from the tip until stopped so that withdrawal thereof will aspirate a predetermined amount of fluid into the pipette from a fluid source and being movable thereafter toward the tip until stopped thereby projecting the fluid from the pipette.

* * * * *

UNITED STATES PATENT OFFICE

CERTIFICATE OF CORRECTION

PATENT NO. : 4,050,316

DATED : September 27, 1977

INVENTOR(S) : EDWARD J. RAPOZA

It is certified that error appears in the above-identified patent and that said Letters Patent are hereby corrected as shown below:

Col. 1, line 29, after the word "residual" the word --fluid-- should be inserted.

Col. 4, line 26, the word "reciprocating" should read --reciprocation--.

Col. 4, line 31, the number "56" should read --57--.

Col. 4, line 39, after the word "shown" second occurrence the word "in" should read -- as --.

Col. 6, line 18, the word "to" should read --and--.

Col. 7, line 33, after the word "is" the word --then-- should be inserted.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*